US008955353B2

(12) United States Patent
Harris et al.

(10) Patent No.: US 8,955,353 B2
(45) Date of Patent: Feb. 17, 2015

(54) FOOD SERVER ASSEMBLY

(75) Inventors: E. Mark Harris, McHenry, IL (US); Frances M. Coursey, Bartlett, IL (US); Jill Zmrhal, Plainfield, IL (US)

(73) Assignee: Columbia Insurance Company, Omaha, NE (US)

( * ) Notice: Subject to any disclaimer, the term of this patent is extended or adjusted under 35 U.S.C. 154(b) by 408 days.

(21) Appl. No.: 13/052,513

(22) Filed: Mar. 21, 2011

(65) Prior Publication Data

US 2011/0259897 A1 Oct. 27, 2011

Related U.S. Application Data

(60) Provisional application No. 61/327,970, filed on Apr. 26, 2010.

(51) Int. Cl.
*F25D 3/08* (2006.01)

(52) U.S. Cl.
CPC ..... *F25D 3/08* (2013.01); *F25D 2303/0822* (2013.01); *F25D 2303/08222* (2013.01); *F25D 2303/0845* (2013.01)
USPC .. 62/457.6; 62/457.2; 220/23.88; 220/592.01

(58) Field of Classification Search
USPC ..... 62/457.6, 457.2, 371, 457.7, 372, 337, 62/457.1, 430, 438; 220/23.86, 23.83, 220/23.88, 507, 505, 556, 575, 592.03, 508, 220/529; 206/541, 545, 546
See application file for complete search history.

(56) References Cited

U.S. PATENT DOCUMENTS

| | | | | |
|---|---|---|---|---|
| 1,429,207 | A | | 9/1922 | Koppelman et al. |
| 1,543,443 | A | | 6/1925 | Koppelman |
| D112,168 | S | | 11/1938 | Bennett |
| 2,634,039 | A | | 4/1953 | Schwertfeger |
| 3,130,288 | A | | 4/1964 | Monaco et al. |
| D216,186 | S | | 12/1969 | Edwards |
| 3,484,035 | A | * | 12/1969 | Swett et al. ..... 220/508 |

(Continued)

FOREIGN PATENT DOCUMENTS

| | | | |
|---|---|---|---|
| CN | 201302343 | Y | 9/2009 |
| CN | 201308209 | Y | 9/2009 |

(Continued)

OTHER PUBLICATIONS

International Preliminary Report on Patentability dated Oct. 30, 2012 for PCT Application No. PCT/US2011/029163.

(Continued)

*Primary Examiner* — Cheryl J Tyler
*Assistant Examiner* — David Teitelbaum
(74) *Attorney, Agent, or Firm* — Neal, Gerber & Eisenberg LLP

(57) ABSTRACT

A device for storing food and displaying food for service includes a base with a side wall extending upwardly from the base and a puck assembly removably disposed therein. The puck assembly has a generally flat plate surface on one side and a functional surface with a plurality of food receptacles formed thereon on the opposite side, a sealed cavity disposed between the plate surface and the functional surface, and a cooling substance disposed in the sealed cavity. A food tray is disposed proximate the puck assembly, and a lid shaped to alternatively fit on the top surface of the wall of the base and to fit on the external surface of the bottom of the base such that the base can nest in the lid.

19 Claims, 14 Drawing Sheets

(56) References Cited

U.S. PATENT DOCUMENTS

| | | | | |
|---|---|---|---|---|
| 3,493,164 | A | 2/1970 | Edwards | |
| 3,710,589 | A | 1/1973 | Brown et al. | |
| 3,859,819 | A | 1/1975 | Kaplan | |
| 3,920,178 | A | 11/1975 | Moller | |
| 4,147,277 | A | 4/1979 | Bateman et al. | |
| 4,287,943 | A | 9/1981 | Hotta | |
| 4,383,422 | A | 5/1983 | Gordon et al. | |
| 4,520,633 | A | 6/1985 | Hoydic | |
| 4,532,397 | A * | 7/1985 | McClelland | 219/733 |
| 4,553,692 | A | 11/1985 | Padovani | |
| 4,567,877 | A | 2/1986 | Sepahpur | |
| D286,360 | S | 10/1986 | Trivison | |
| 4,650,076 | A | 3/1987 | Padovani | |
| 4,741,176 | A | 5/1988 | Johnson et al. | |
| 4,842,143 | A | 6/1989 | McKee, Sr. et al. | |
| 4,869,387 | A | 9/1989 | Persson | |
| 4,898,273 | A | 2/1990 | Kristiansen | |
| 4,924,048 | A | 5/1990 | Bunce et al. | |
| 4,989,419 | A | 2/1991 | Brando et al. | |
| 5,307,647 | A * | 5/1994 | McClure | 62/371 |
| 5,423,449 | A | 6/1995 | Gordon et al. | |
| 5,538,136 | A | 7/1996 | Onneweer | |
| 5,568,735 | A | 10/1996 | Newkirk et al. | |
| 5,689,970 | A * | 11/1997 | Chopas | 62/372 |
| 5,701,757 | A | 12/1997 | Heverly | |
| 5,704,485 | A * | 1/1998 | Cautereels et al. | 206/546 |
| 5,890,613 | A | 4/1999 | Williams | |
| 6,012,583 | A | 1/2000 | Ramirez | |
| 6,085,535 | A | 7/2000 | Richmond et al. | |
| 6,086,931 | A | 7/2000 | Whiteford | |
| D444,058 | S | 6/2001 | Hampshire et al. | |
| 6,250,104 | B1 | 6/2001 | Bostic | |
| 6,378,325 | B1 | 4/2002 | Yang | |
| D459,950 | S | 7/2002 | Bush et al. | |
| 6,419,089 | B1 | 7/2002 | Dall | |
| 6,434,961 | B2 | 8/2002 | Richmond et al. | |
| 6,540,084 | B2 | 4/2003 | Silvers | |
| 6,581,795 | B1 | 6/2003 | Schulein et al. | |
| 6,601,403 | B1 | 8/2003 | Roth et al. | |
| 6,761,041 | B2 | 7/2004 | Roth et al. | |
| 6,843,062 | B2 | 1/2005 | Crete | |
| 6,851,274 | B2 | 2/2005 | Martino | |
| 6,938,793 | B2 * | 9/2005 | Lerner | 220/574.2 |
| D515,880 | S | 2/2006 | Lerner | |
| 7,007,813 | B2 | 3/2006 | Yang | |
| D524,662 | S | 7/2006 | Fager et al. | |
| 7,131,289 | B2 | 11/2006 | Harl et al. | |
| 7,225,633 | B2 | 6/2007 | DeMars | |
| 7,288,745 | B2 | 10/2007 | Colonna | |
| 7,353,951 | B2 | 4/2008 | Vovan | |
| 7,427,001 | B1 | 9/2008 | Keitges | |
| 7,438,200 | B1 | 10/2008 | Keitges | |
| D605,470 | S | 12/2009 | Sluiman | |
| D626,380 | S | 11/2010 | Harris | |
| D632,526 | S | 2/2011 | Coursey et al. | |
| D634,164 | S | 3/2011 | Coursey | |
| 2003/0226844 | A1 | 12/2003 | Felknor et al. | |
| 2005/0072711 | A1 * | 4/2005 | Yang | 206/545 |
| 2006/0065702 | A1 | 3/2006 | Beese | |
| 2006/0091129 | A1 | 5/2006 | Colonna | |
| 2007/0284358 | A1 | 12/2007 | Claffy | |
| 2008/0087037 | A1 | 4/2008 | Rapaz | |
| 2008/0216507 | A1 | 9/2008 | Tremblay | |
| 2008/0283437 | A1 | 11/2008 | St-Onge | |

FOREIGN PATENT DOCUMENTS

| | | |
|---|---|---|
| DE | 3907292 | 2/1990 |
| JP | 2004/149133 A | 5/2004 |
| WO | WO 87/02336 | 4/1987 |
| WO | WO 99/08944 | 2/1999 |

OTHER PUBLICATIONS

International Search Report dated Nov. 24, 2011 for PCT Application No. PCT/US2011/029163.

Australian Office Action dated Jun. 6, 2014 for Australian Patent Application No. 2011248994.

Chinese Office Action dated Apr. 14, 2014 for Chinese Patent Application No. 201180020963.2.

* cited by examiner

FOOD SERVER ASSEMBLY

This application claims the benefit of U.S. Provisional Patent Application No. 61/327,970 filed on Apr. 26, 2010, which is incorporated herein in its entirety.

BACKGROUND OF THE INVENTION

This invention relates to a food server assembly incorporating various modules.

SUMMARY OF THE INVENTION

An improved food server assembly is disclosed herein, as disclosed in more detail below. The food server comprises multiple modules that can be used in a variety of ways, giving the user significant flexibility in how the food server is used.

A better understanding of the objects, advantages, features, properties and relationships of the invention will be obtained from the following detailed description and accompanying drawings which set forth illustrative embodiments that are indicative of the various ways in which the principles of the invention may be employed.

DETAILED DESCRIPTION OF THE DRAWINGS

Figure 1:
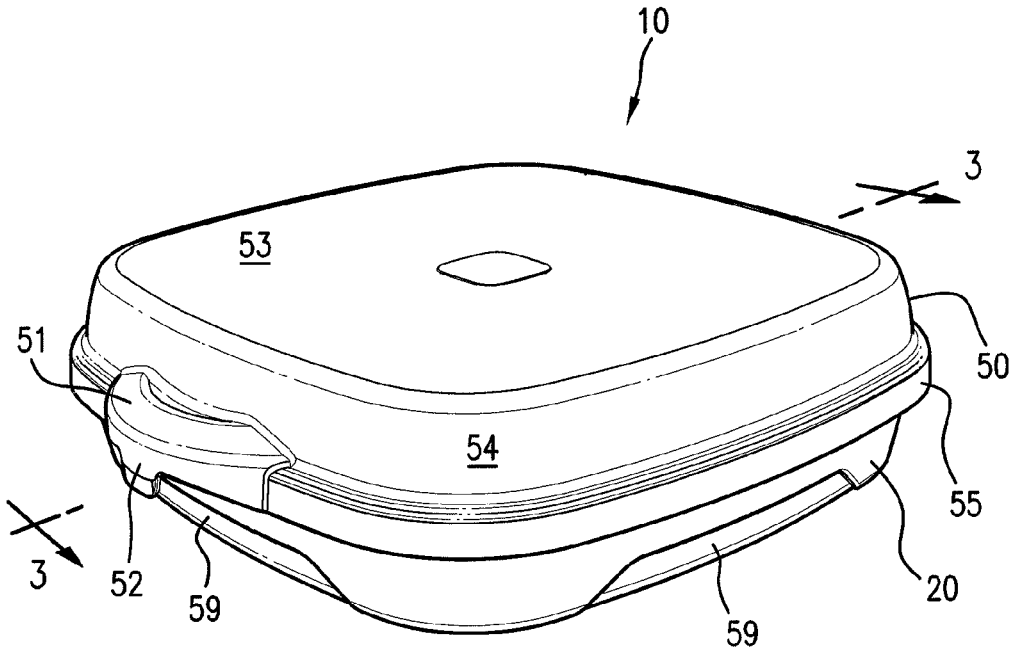
FIG. 1 is a perspective view of a food server assembly in accordance with one embodiment of the present invention.

The description that follows describes, illustrates and exemplifies one or more embodiments of the present invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the present specification is intended to be taken as a whole and interpreted in accordance with the principles of the present invention as taught herein and understood by one of ordinary skill in the art.

Figure 12:
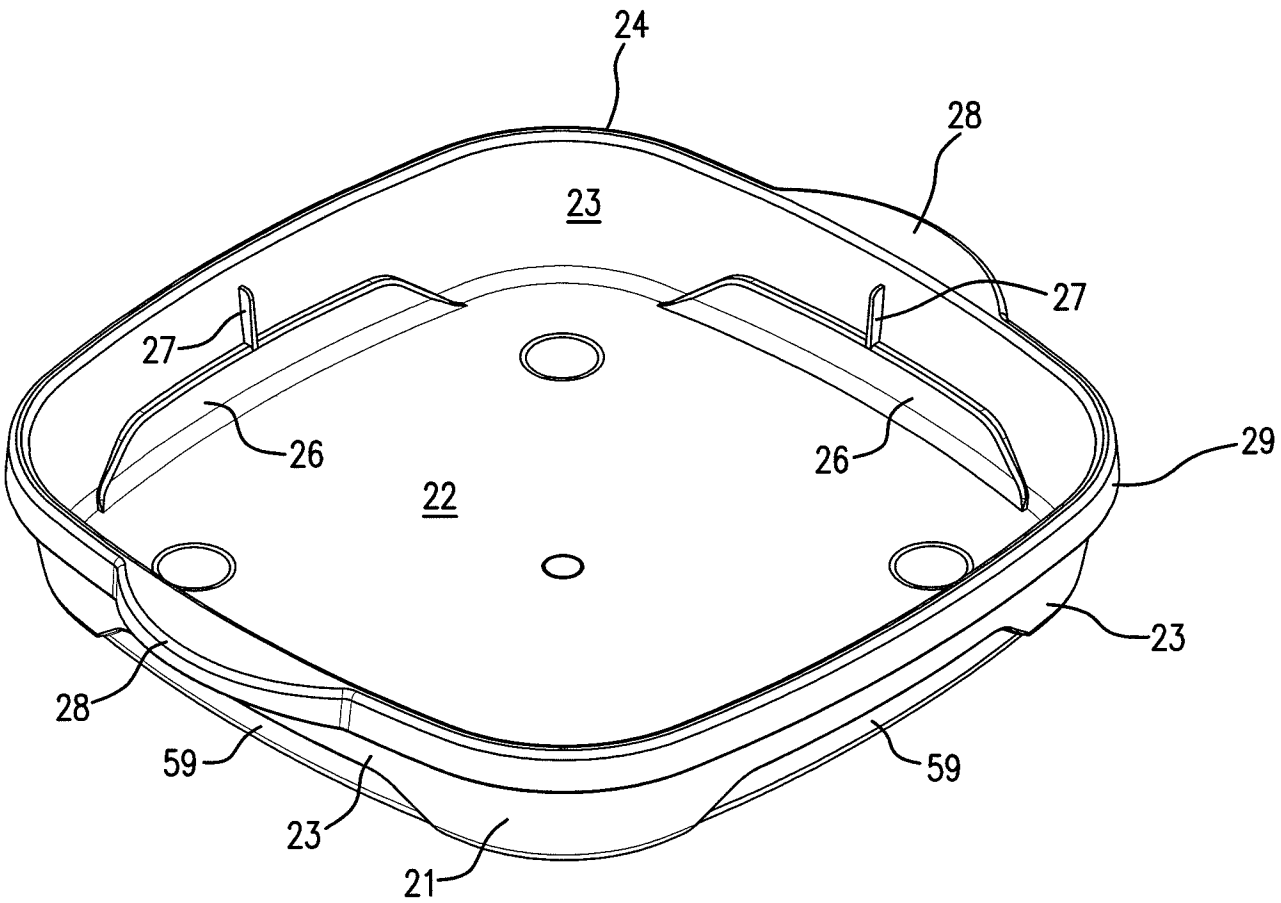
FIG. 12 is a perspective view of the base of the food server.
Figure 13:
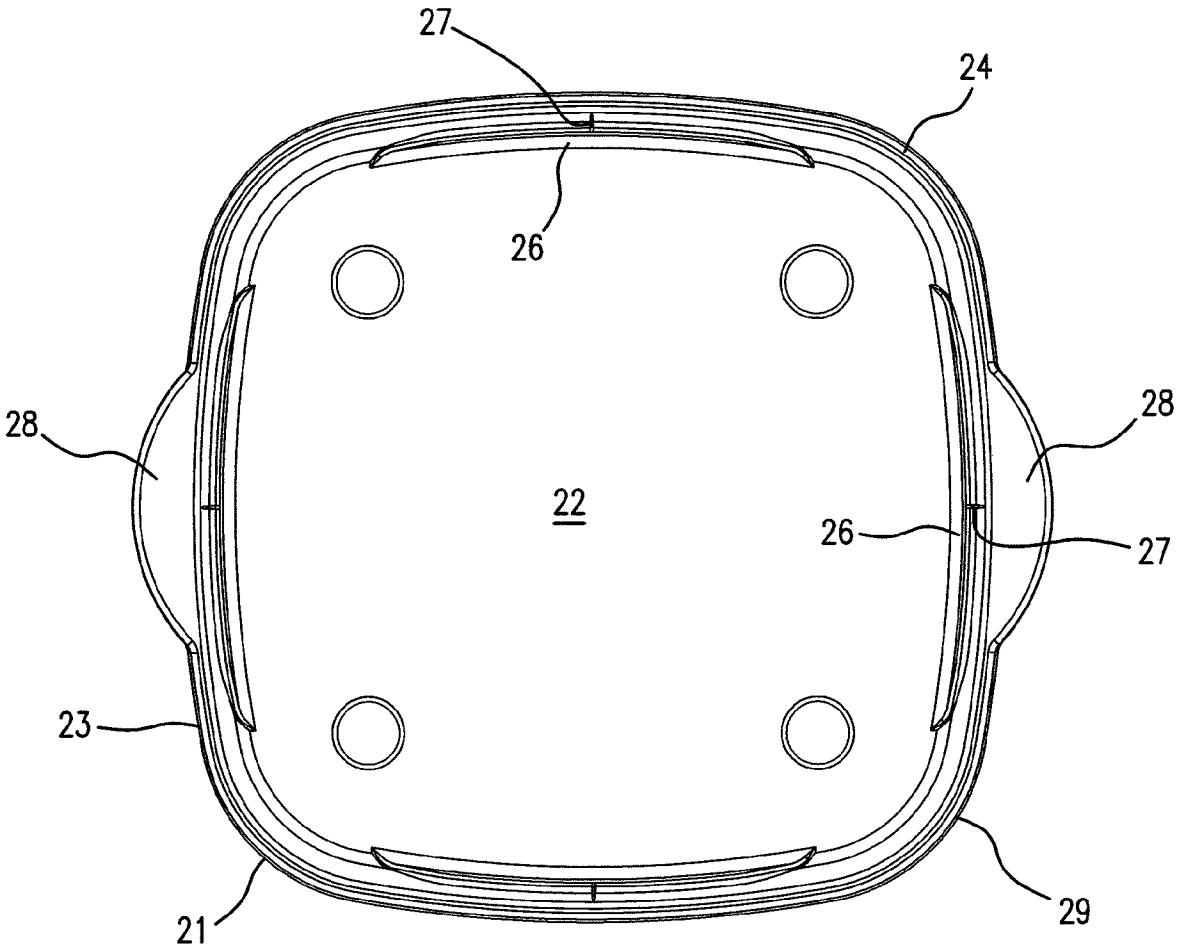
FIG. 13 is a top plan view of the base of FIG. 12.

Food server assembly 10 comprises base portion 20, a pair of puck assemblies 30, a pair of food trays 40 and lid 50. As shown in detail in FIGS. 2, 12 and 13, base 20 comprises external surface 21 and a bottom internal surface 22. Walls 23 extend upwardly from internal surface 22 to define a single side wall defining an internal space 25. Walls 23 terminate in lip surface 24 around the circumference of base 20 and an external rim 29 extends downwardly therefrom.

A plurality of shelf structures 26 are positioned within internal space 25, each wall 23 having one shelf structure 26 formed thereon. A plurality of stops 27 are also positioned within internal space 25, each wall 23 having one of the stops 27 formed thereon. In the depicted embodiment, each stop 27 is positioned adjacent to its respective shelf structure 26. Handles 28 are formed on external surface 21 of opposing walls 23. A plurality of indentations 59 are formed on external surface 21 of walls. In the depicted embodiment, indentations 59 correspond to shelf structures 26.

Figure 5:
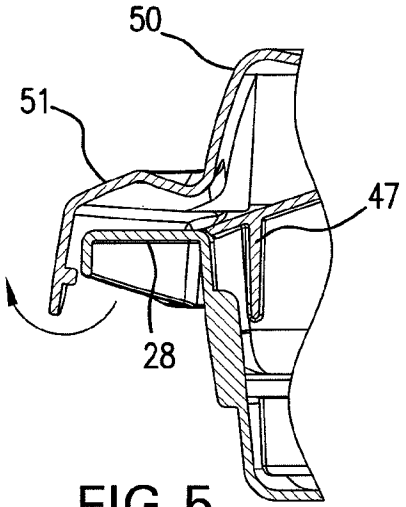
FIG. 5 is a view similar to FIG. 4, with the lid handle disengaged from the base handle.
Figure 4:
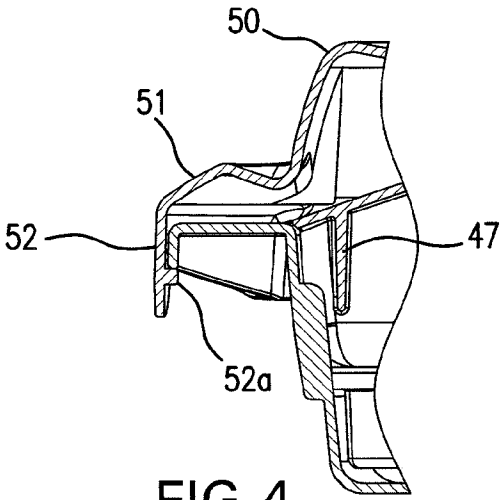
FIG. 4 is a cross-sectional detail view of the lid handle engaged to the base handle, in the engaged position.

As shown in detail in FIGS. 1-5, and 16, lid 50 comprises a pair of lid handles 51 on opposite sides thereof and base 20 comprises a pair of corresponding handles 28 on opposite sides thereof. Each lid handle 51 comprises a downwardly extending portion 52 having a locking tab 52*a* on the inner surface thereof. Lid 50 has a slightly concave top surface 53, and a continuous side wall 54 extending downwardly therefrom along the entire circumference of lid 50. A lip 55 extends outwardly from side wall 54 to engage the corresponding rim 29 extending downwardly from the top of lip surface 24 so as to provide a snug fit for lid 50 on base 20. When lid 50 is placed on base 20, each locking tab 52*a* engages the bottom of the corresponding handle 28 on base 20, to prevent inadvertent removal of lid 50. To remove the lid 50, the user simply pulls handle portions 52 outwardly, as shown in FIG. 5. Lid 50 may also be nested with base 20 when food server assembly 10 is in use. Lid 50 comprises a plurality of support structures 57 formed on the inside surface 56 of wall 54. While nested, support structures 57 engage indentations 59 to support base 20. In this manner, downward portions 52 and locking tabs 52*a* remain clear of handles 28, such that a user may easily remove base 20 from lid. 50 when the user is finished with food assembly 10 and ready for transport. Lid 50 and base 20 are preferably composed of a transparent plastic such as Luran.

Figure 2:
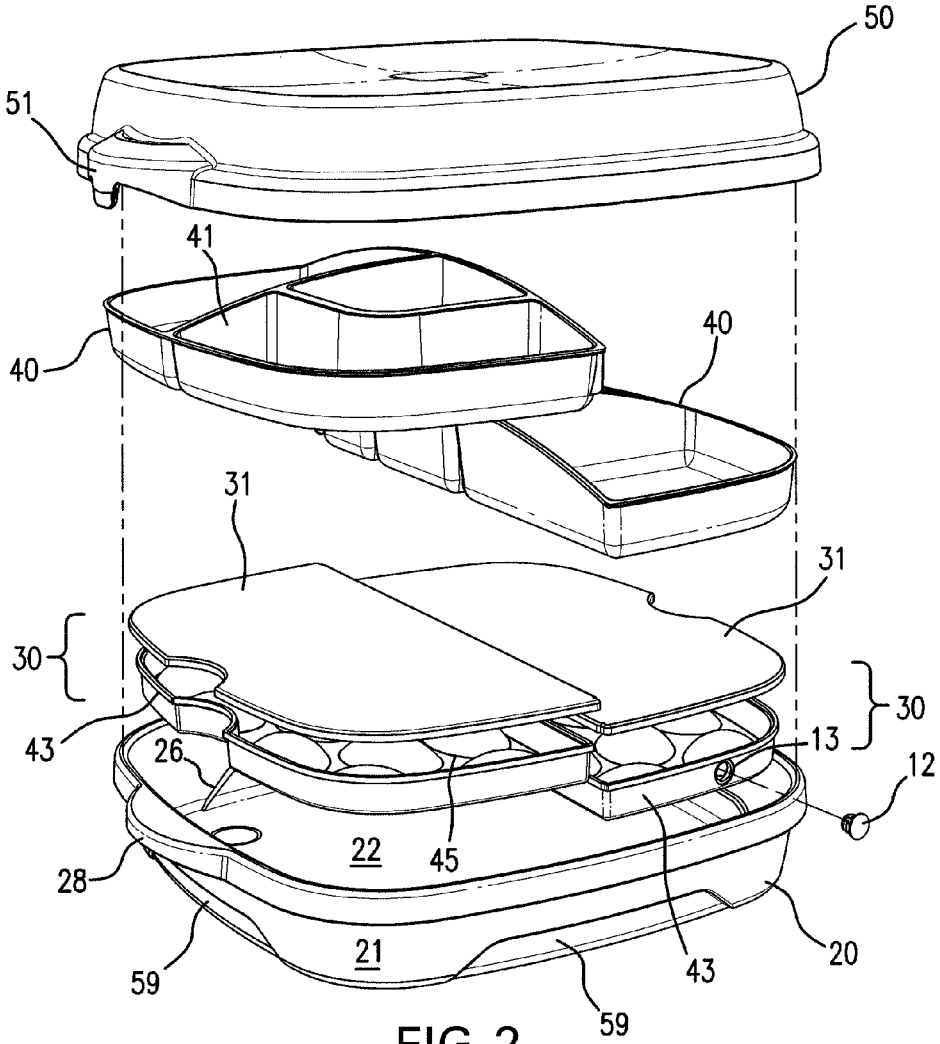
FIG. 2 is an exploded perspective view of the food server assembly of FIG. 1.
Figure 3:
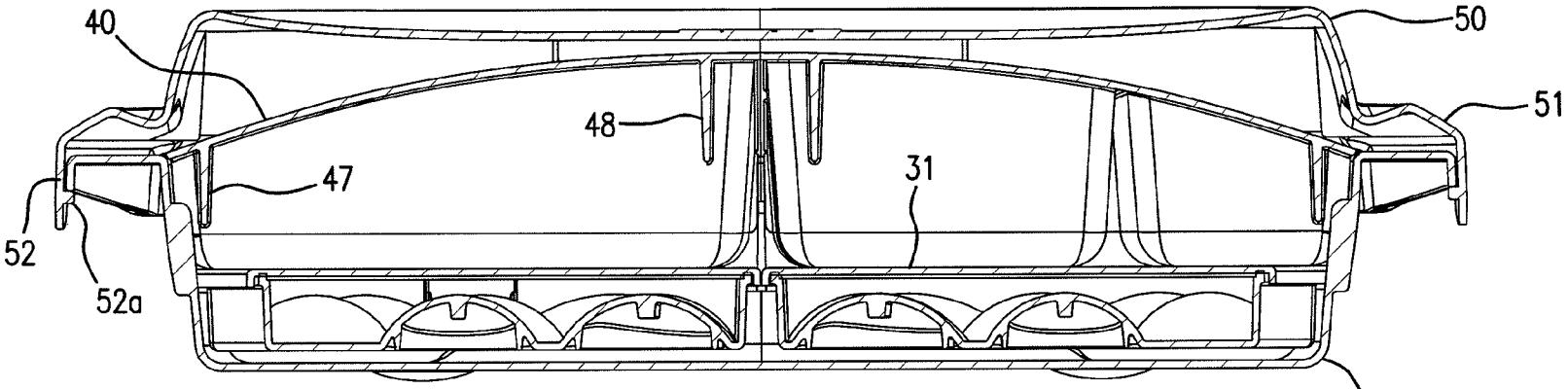
FIG. 3 is a cross-sectional side view of the food server assembly, along the lines 3-3 of FIG. 1.
Figure 8:
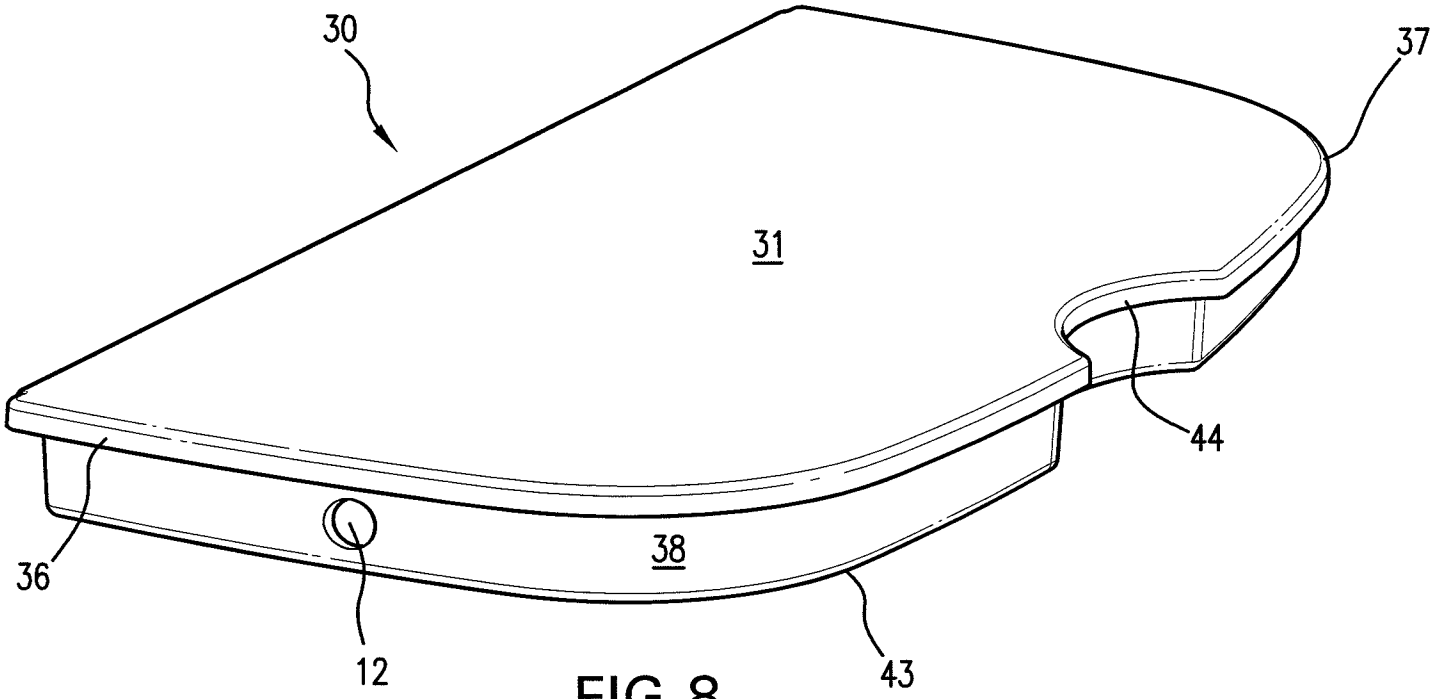
FIG. 8 is a top perspective view of one of the puck assemblies in accordance with one embodiment of this invention.
Figure 9:
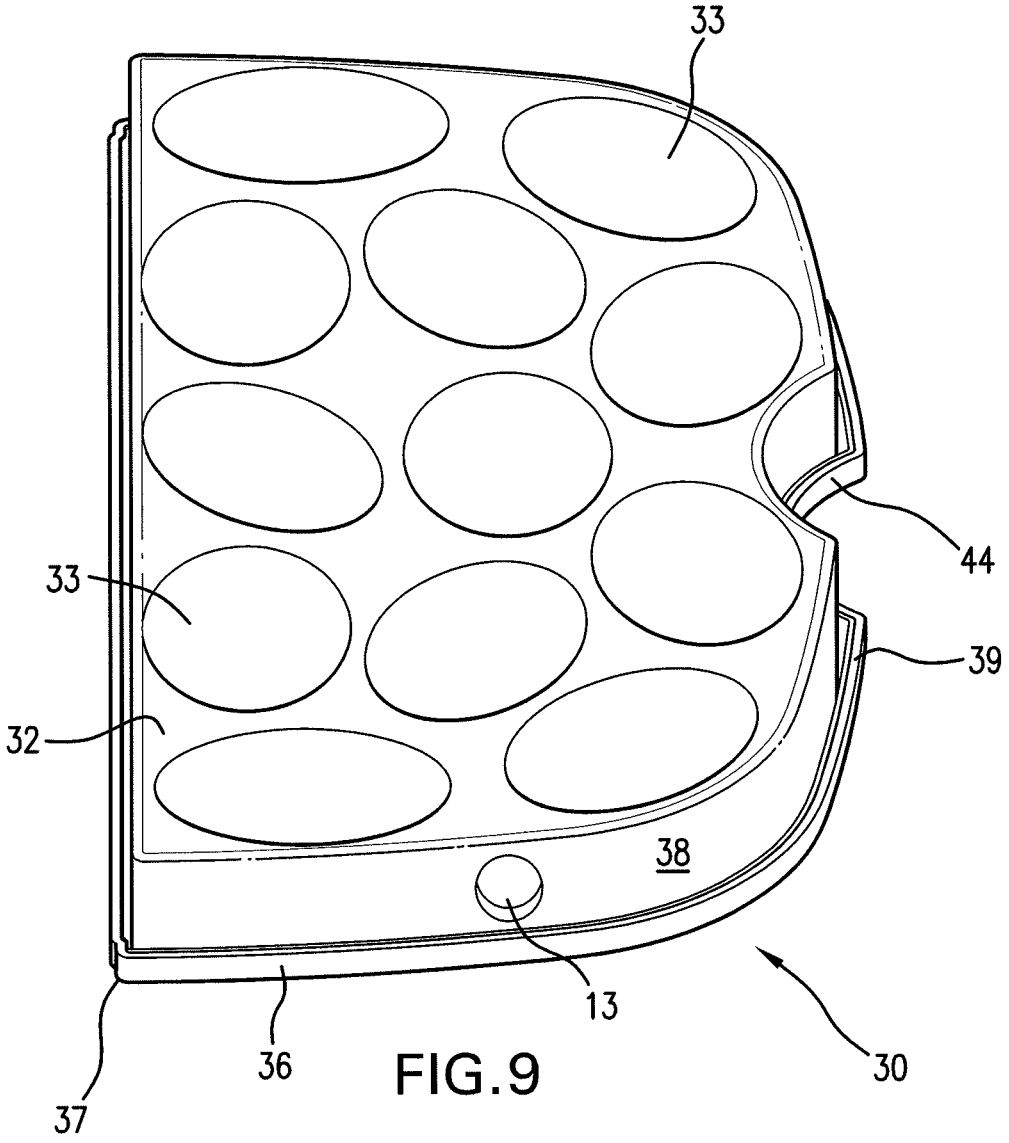
FIG. 9 is a bottom perspective view of the puck assembly of FIG. 8, with a minor variation as discussed herein.

Puck assembly 30 is shown in detail in FIGS. 2, 8 and 9. Each puck assembly 30 comprises generally flat plate surface 31 secured to puck body 43 to form a sealed cavity 45 into which a cooling substance (not shown) may be inserted. A hole 13 is provided in each puck body 43 to allow access to sealed cavity 45 for the insertion of the cooling substance, and once the substance is inserted, plug 12 is secured in hole 13 to seal the cooling substance in puck assembly 30, by means of a known method such as wings on plug 12 that snap in place and a cement such as methyl ethyl ketone (MEK). For example, an acrylic plastic cement such as that sold under the brand name Weld-On #1802 may be used. Hole 13 may be located on a first side of puck assembly 30 as shown in FIG. 8, or on a second side of puck assembly 30, opposite the first side, as shown in FIG. 9. It will be obvious to those in the art that the scope of the present invention includes those embodiments in which hole 13 is situated on either side of puck assembly 30.

The cooling substance is of the type that can be repeatedly cooled and thawed and can retain a temperature for a period of time, and various known substances, such as gels and liquids, can be used. In the depicted embodiment, the substance is the type sold under the brand name +30F Johnny Plastic Ice gel by Pelton Shepherd, but similar gels used in the food service industry would also be acceptable. In use, each puck assembly 30 is removed from food server assembly 10 and placed in a freezer for a predetermined time to achieve the desired temperature, with the time depending on the characteristics of the cooling substance. After the puck assemblies 30 have been chilled sufficiently, they may be returned to food server assembly 10.

Functional surface 32 is formed on puck body 43 generally opposite to flat plate surface 31, and comprises a plurality of food receptacles 33 formed thereon. In the depicted embodiment, each food receptacle 33 is oval shaped to hold eggs. By way of example only, food receptacle 33 could be used to display and serve deviled eggs. It will be appreciated by those in the art that other shapes could be used within the scope of the present invention for use with other types of foods, and that other orientations of the shapes may be used. By way of example only, food receptacles 33 may all be oriented in a uniform, diagonal manner, rather than some vertical, some diagonal and some horizontal, as depicted.

Figure 10:
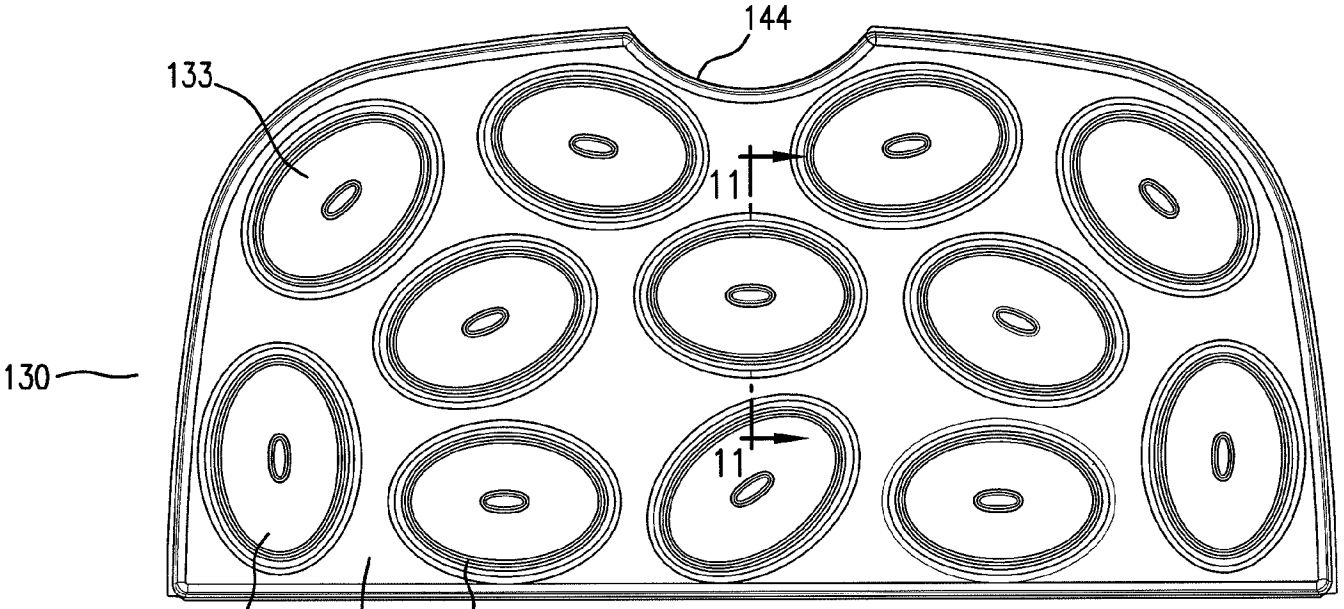
FIG. 10 is a top plan view of a puck assembly in accordance with a second embodiment of this invention.
Figure 11:
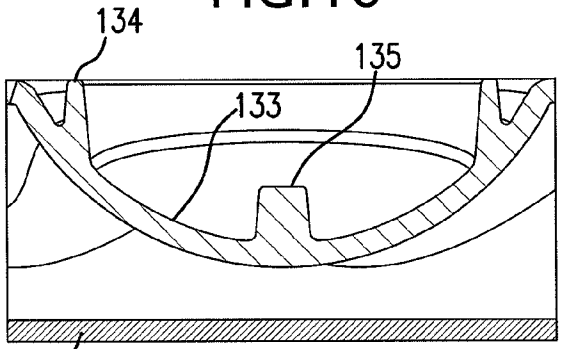
FIG. 11 is a cross-sectional detail view of one of the food receptacles of the puck assembly of FIG. 10, along the lines 11-11.

An alternative puck assembly 130 is depicted in FIGS. 10 and 11, where each food receptacle 133 comprises a rib or ridge structure 134 and a center protrusion 135. The ridge 134 and center protrusion 135 lessen the surface area on which any food placed in the food receptacle 133 sits, and create an air gap below the food item, thereby aiding in preventing the food item from sticking to puck assembly 130. For example, the soft surface of a deviled egg may stick to a very cold surface, thereby damaging the egg when it is removed, and this embodiment helps to avoid such problems.

While the depicted embodiment displays two identical puck assemblies 30, it will be appreciated by those in the art that the scope of the present invention includes embodiments in which the puck assemblies are not identical in appearance, or there is only one puck assembly or more than two puck assemblies. By way of example, the functional surface 32 or 132 may be present on one puck assembly and not the other, or the food receptacles 33 or 133 may be of different shapes on each functional surface 32 or 132.

Other than the shape of food receptacle 33 and 133, puck assemblies 30 and 130 may be identical, so discussion here will focus only on puck assemblies 30. Each puck assembly 30 has a rim 37 extending around the circumference of flat plate surface 31, including a bottom surface 39, which is parallel to and offset below flat plate surface 31, and flat side edge 36 is formed on the outer circumference of rim 37. Puck body 43 includes a side wall 38 extending downwardly below rim 37 to functional surface 32, where sidewall 38 is offset inwardly from flat side edge 36 of rim 37.

In use, each puck assembly 30 may be removably disposed in internal space 25 in a first orientation, in which bottom surface 39 of rim 37 is disposed on at least a portion of two shelf structures 26 such that functional surface 32 is proximate to internal surface 22. Each puck assembly 30 may also be disposed in a second orientation, in which flat plate surface 31 is disposed on at least a portion of two shelf structures 26 so that functional surface 32 is facing upwards. It will be appreciated by those in the art that each puck assembly 30 may be disposed in the first or second orientation, independent of the orientation of the other puck assembly 30. It will also be understood that the two puck assemblies could be combined into a single unitary unit.

Figure 14:
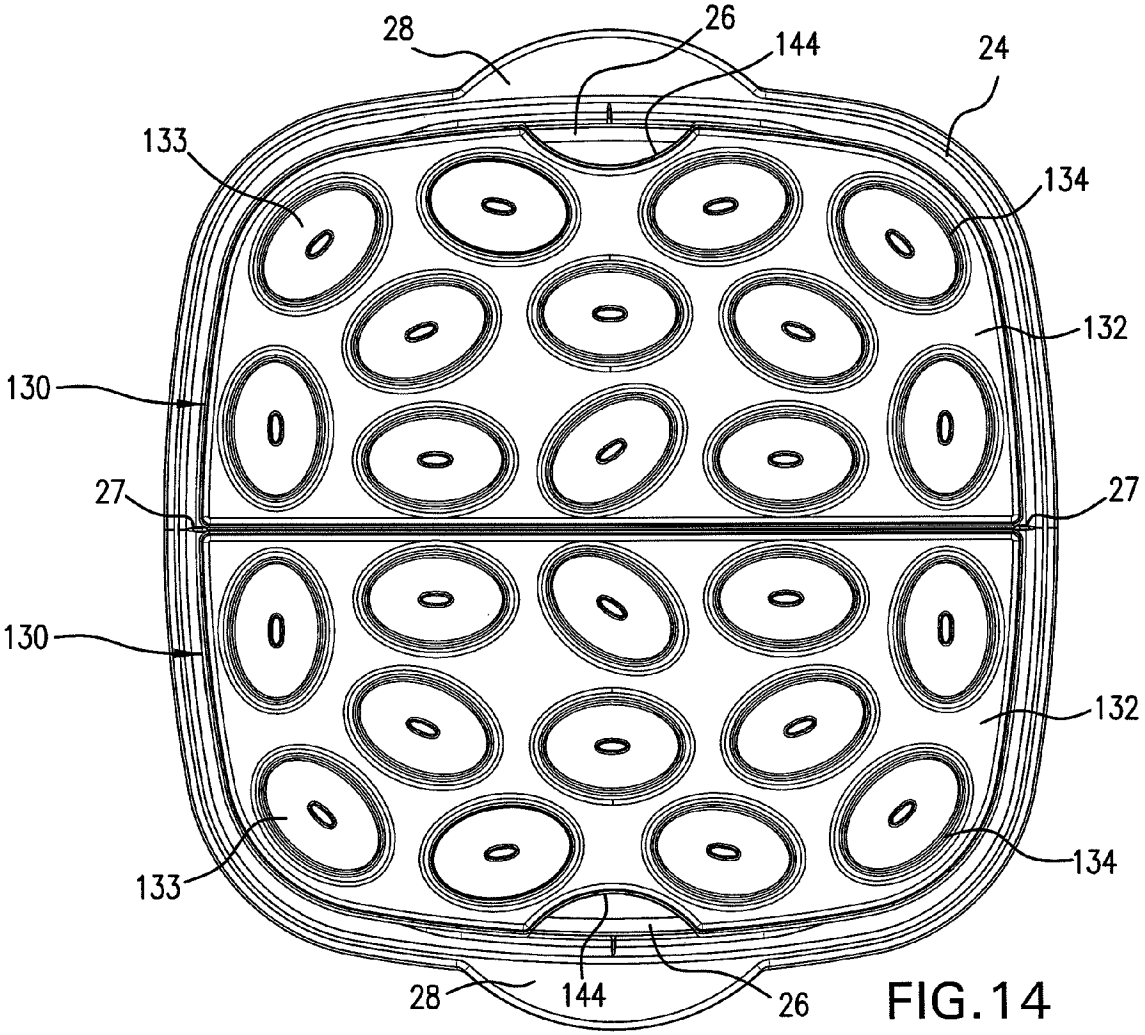
FIG. 14 is a top plan view of the base with two puck assemblies inserted therein, with their functional surfaces facing upwardly.
Figure 15:
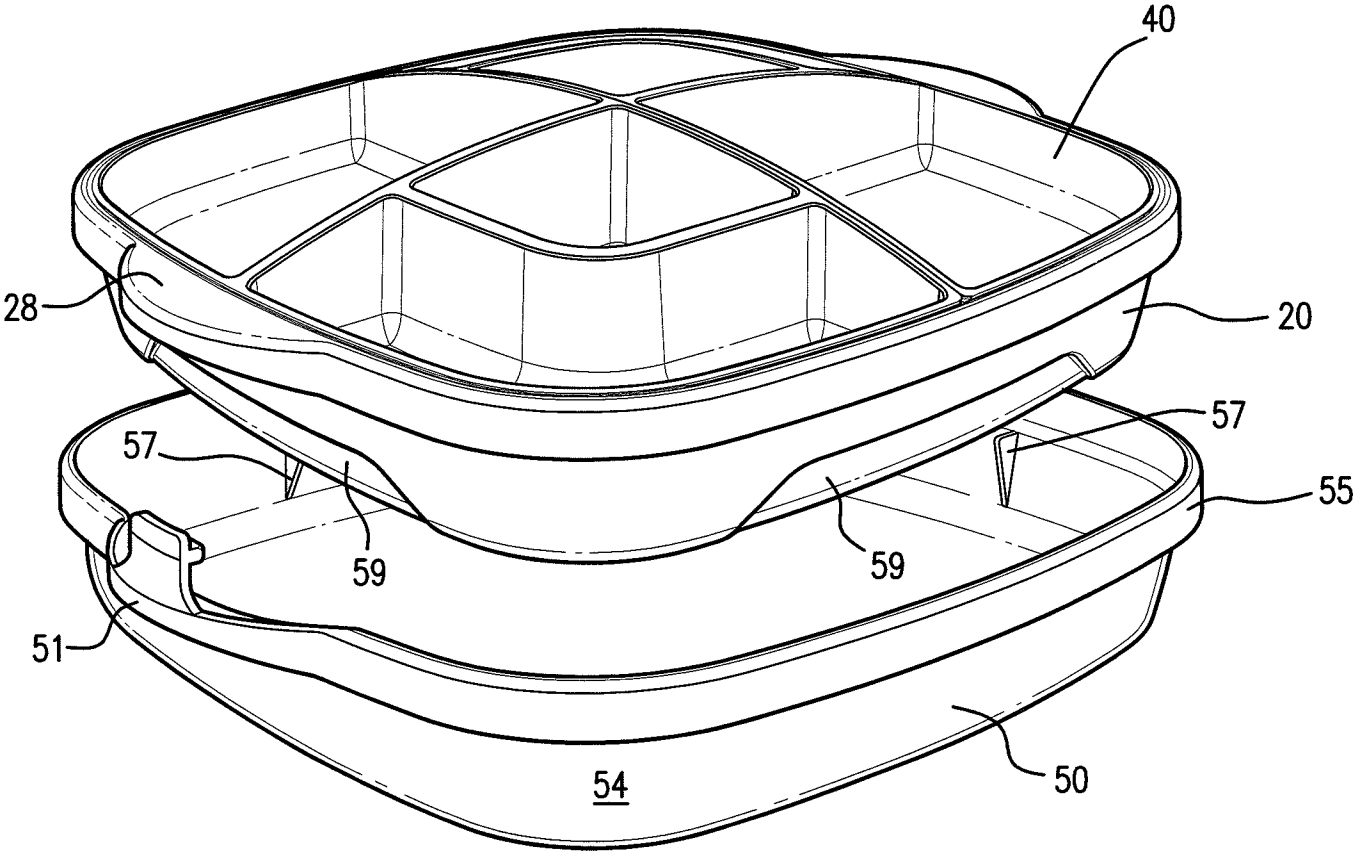
FIG. 15 is a perspective view of the base, food trays and lid of the food server of FIG. 1, showing an alternative arrangement of the elements.
Figure 16:
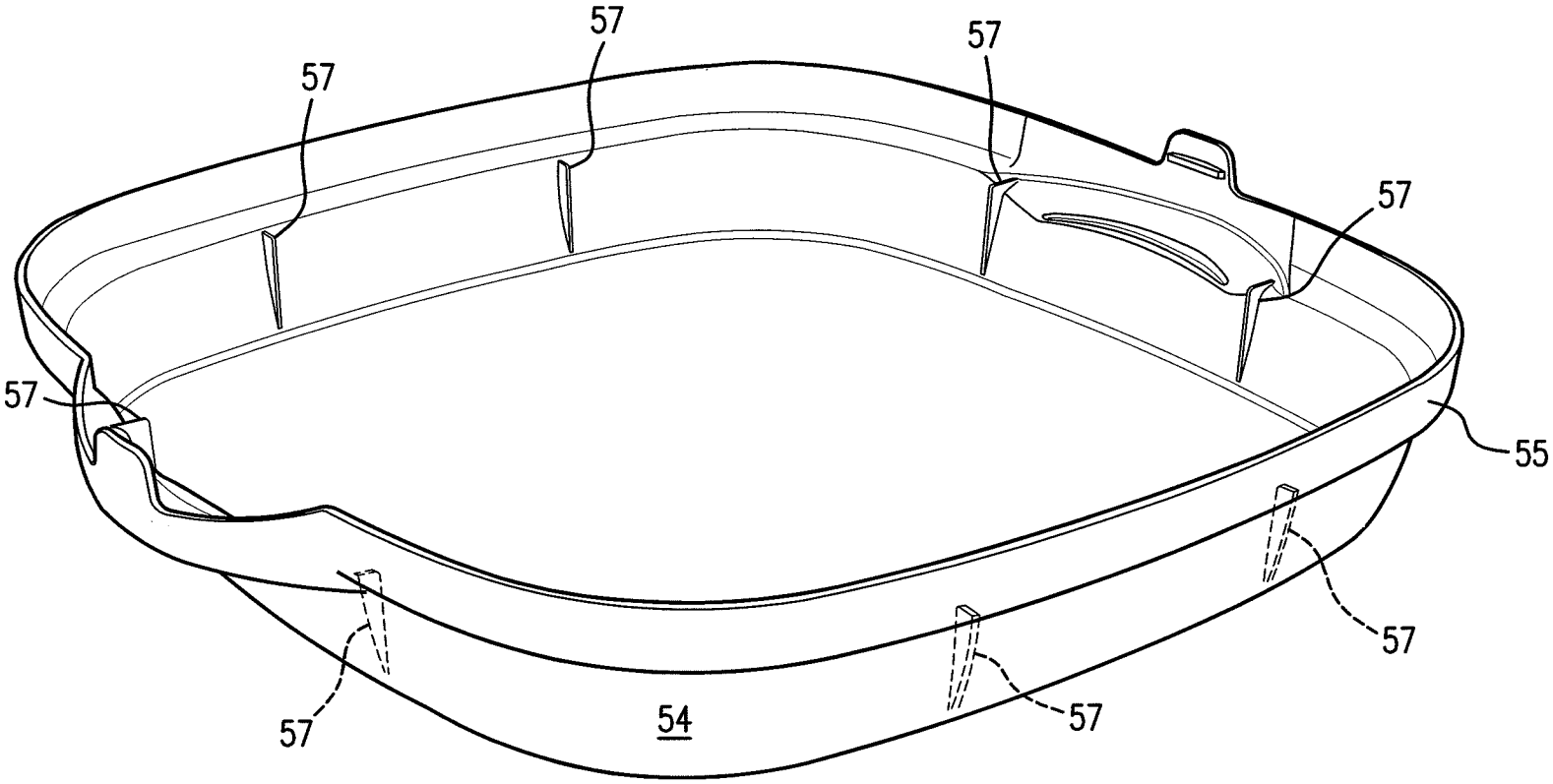
FIG. 16 is a perspective view of the inside of the lid of the food server.
Figure 17:
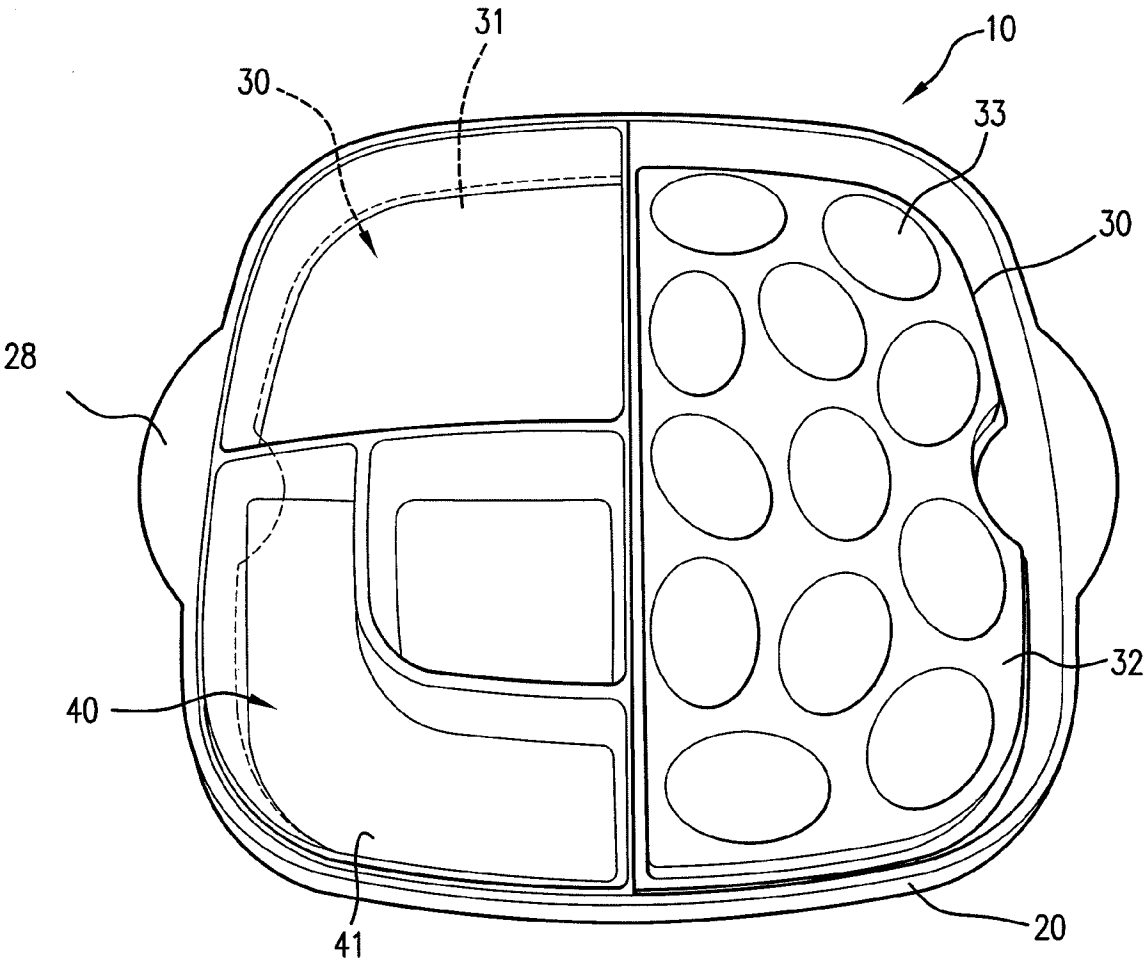
FIG. 17 is a top plan view of the base with one puck assembly with its functional surface facing upwardly and one food tray inserted therein.

FIG. 14 depicts the puck assemblies 130 inserted into base 20, in the second orientation, with their functional surfaces facing upwards to permit the use of food server 10 as a deviled egg server. In such a use, food trays 40 are removed from food server 10 and may be either stored or used on their own as separate servers.

Because rim 37 extends outwardly from side wall 38, puck assemblies 30 or 130 are disposed lower in the base 20 when they are the first orientation than when they are in the second orientation. The first orientation thus permits sufficient space for food trays 40 to be placed on top of the puck assemblies 30 as shown in, e.g., FIGS. 2, 3, and 6, while the second orientation places the food receptacles 33 or 133 higher in base 20 for a better display of the food items.

Regardless of the orientation in which the puck assembly 30 is disposed, to prevent lateral movement of the puck assembly 30, a portion of flat side edge 36 of each puck assembly 30 will engage two of the stops 27, which are formed on opposite walls 23.

Figure 6:
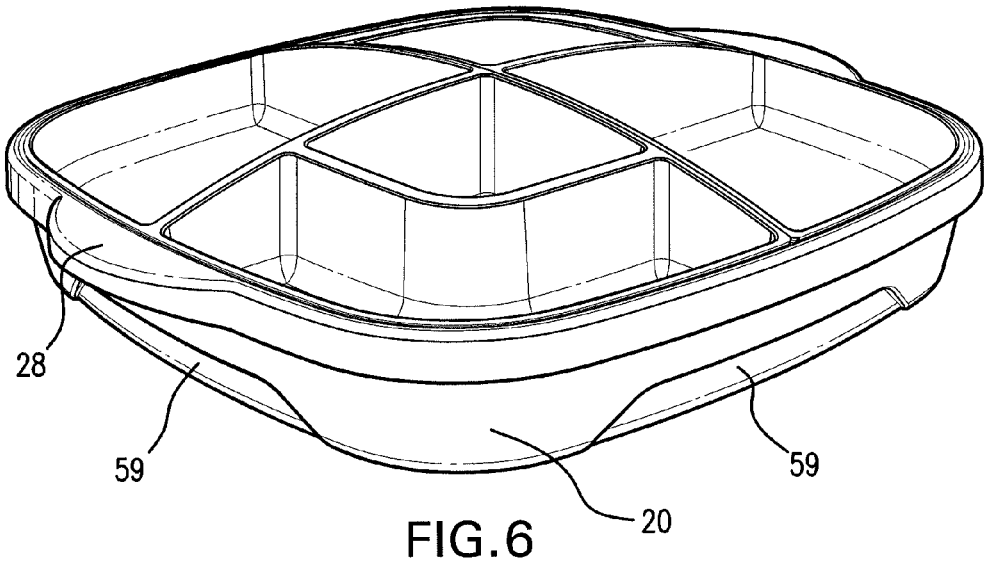
FIG. 6 is a perspective view of the base of the food server assembly, with two food trays inserted therein.
Figure 7:
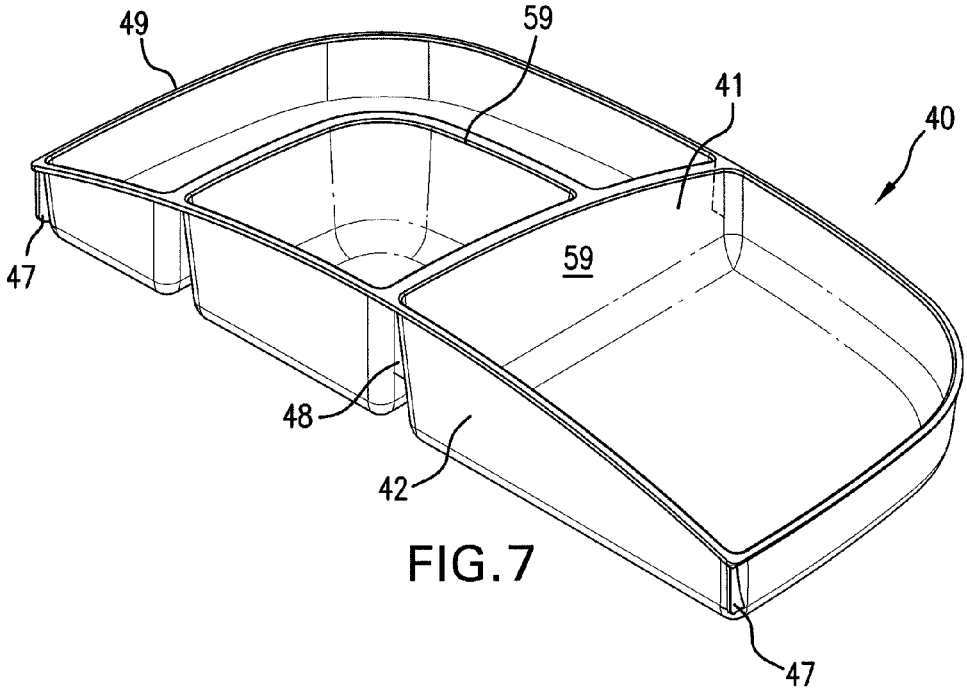
FIG. 7 is a perspective front view of one of the removable food trays.

One of the food trays 40 is shown in detail in FIG. 7. While the depicted embodiment displays two identical food trays 40, it will be appreciated by those in the art that the scope of the present invention includes those embodiments in which the food trays are not identical, or there is only one food tray or more than two food trays. Each food tray 40 comprises an outer wall 49, flat bottom surface 46, flat edge 42 and a plurality of holding compartments 41 defined in part by internal walls 59. In order to allow for the storage of various types, shapes and kinds of food, each holding compartment 41 may be of a varying dimension. As seen in FIGS. 2 and 6, if food trays 40 are generally identical in size and shape, one may be nested inside the other for ease of storage when they are not needed. However, if food trays 40 are made from soft type of plastic or other pliable material, nesting the food trays 40 when not in use could result in damage or breakage. It will be understood by those in the art that the scope of the present invention includes those embodiments in which the holding compartments are of identical dimensions, as well as those embodiments in which the food trays 40 are not nestable.

Figure 7A:
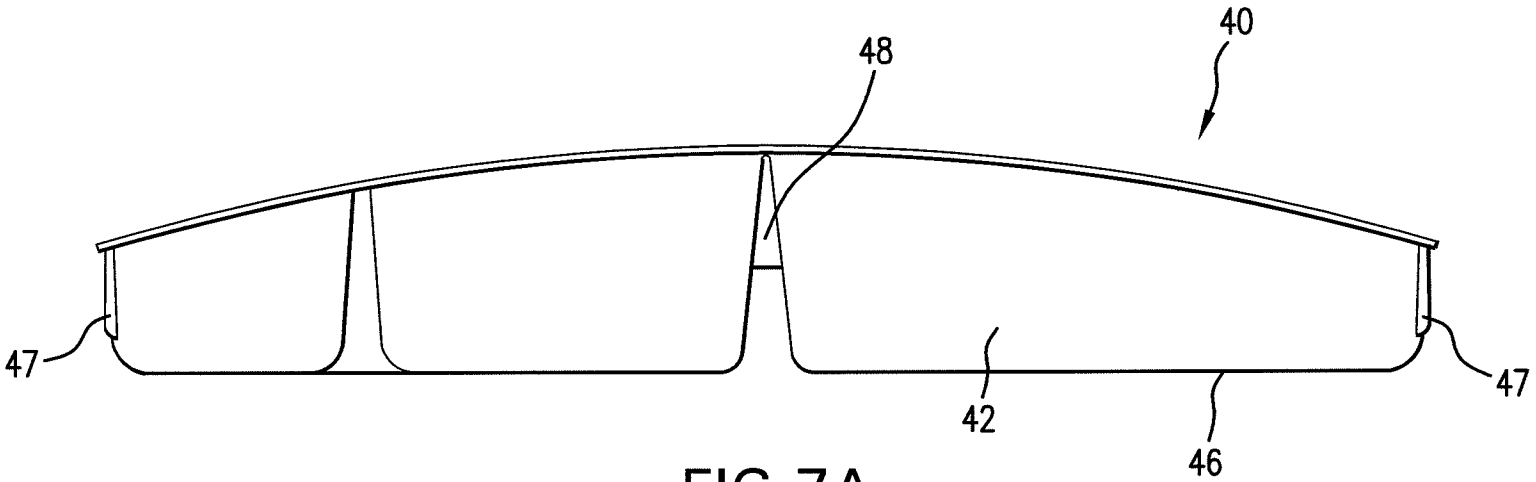
FIG. 7A is a front view of one of the removable food trays.

To aid in nesting the food trays 40, rib 48 and ribs 47 may be formed on tray 40. As seen in FIG. 7A, for example, holding compartments 41 are separated by a gap, in which rib 48 is formed. When nested, the internal walls of a bottom food tray 40 are situated in the gap. As such, rib 48 and ribs 47 support food tray 40, and prevent any internal walls from acting as a wedge to separate holding compartments 41 and damage the top food tray 40.

In use, food trays 40 are disposed in internal space 25. They may used with one or more puck assemblies 30, such that flat bottom 46 rests on one or more puck assemblies 30, or food trays 40 may be disposed directly on one or more shelf structures 26. The latter is useful when the user does not want the food to be chilled, and puck assemblies do not need to be used. In either situation, flat edge 42 may engage two of the stops 27, which are formed on opposite walls 23, to prevent lateral movement of the food tray 40.

Food server 10 is generally symmetrical, so that the elements may be inserted as shown in FIG. 2, or in a different orientation. For example, puck assemblies 30 could be inserted as shown in FIG. 2 while food trays 40 could be rotated 90 degrees. The user could also insert one puck assembly 30 into base 20 and its corresponding food tray 40 on top of it, and turn the other puck assembly 30 upside down so that its functional surface 132 is facing upwardly. This gives the user the ability to serve deviled eggs or some other food item on the second puck assembly 30 and other food items on the food tray 40 being used. As another alternative, both puck assemblies could be removed, and both food trays 40 installed, permitting the service of food that may not require chilling. It will be obvious to those skilled in the art that use of a soft plastic or other pliable material for food trays 40 may result in food trays 40 bowing when used without puck assemblies 30, making it difficult to remove lid 50. All of these options demonstrate the great flexibility permitted by food server 10, and it will be understood by one of ordinary skill in the art that many other alternative arrangements are possible.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A device for storing food or displaying food for service, the device comprising:

a base comprising a bottom and a first side wall extending upwardly from the bottom and terminating in a lip surface, wherein an internal surface of the bottom and the first side wall form an internal space;

at least one puck assembly removably disposed in the internal space, the at least one puck assembly comprising:

a plate surface in a plane parallel to the bottom of the base and a rim extending around a circumference of the plate surface, the rim having a first surface generally parallel to and below the plate surface;

a functional surface formed generally opposite to the plate surface and having a plurality of food receptacles formed thereon;

a flat second side wall extending perpendicularly to and between the first surface of the rim and the functional surface, the second side wall being offset inwardly from and below the rim;

a sealed cavity defined by the plate surface, the functional surface, and the second side wall; and a cooling substance disposed in the sealed cavity;

wherein the at least one puck assembly may be removably disposed in the internal space in a first orientation, in which the functional surface is adjacent to the internal surface of the bottom and the first surface of the rim is supported by the base, and a second orientation, in which the plate surface is closer to the internal surface of the bottom than is the functional surface and the plate surface is supported by the base, the at least one puck assembly being disposed lower within the base when in the first orientation than when in the second orientation, a food tray removably disposable within the internal space proximate the at least one puck assembly; and a lid shaped to alternatively fit on a top surface of the first side wall to close the internal space, and to fit on an external surface of the base such that the base can nest in the lid.

2. The device of claim 1, wherein the at least one puck assembly comprises a first puck and a second puck.

3. The device of claim 1, further comprising a plurality of shelf structures, each shelf structure being formed on at least a portion of the first side wall, wherein each shelf structure is at an identical height from the internal surface of the bottom of the base.

4. The device of claim 3, wherein the at least one puck assembly rests on the plurality of shelf structures when it is disposed in the internal space.

5. The device of claim 1, wherein the food tray comprises a first tray and a second tray, wherein both the first tray and the second tray each comprise a plurality of holding compartments.

6. The device of claim 5, wherein the base further comprises a plurality of stops formed on an internal surface of the first side wall.

7. The device of claim 1, further comprising a first pair of handles disposed on opposite sides of the base.

8. The device of claim 7, wherein the lid further comprises a second pair of handles disposed on opposite sides of the lid, wherein each of the second pair of handles is shaped to engage with one of the first pair of handles both when the lid is engaged to the lip surface and when the lid is engaged to the external surface of the base.

9. The device of claim 8, wherein each food receptacle is shaped to receive an egg and comprises a ridge to prevent the egg from sticking to the food receptacle.

10. A device for storing food or displaying food for service, the device comprising:

a base comprising a bottom and a plurality of walls extending from the bottom to define an internal space, the plurality of walls comprising a first wall, a second wall formed opposite the first wall, a third wall disposed between the first wall and the second wall, and a fourth wall formed opposite the third wall, the bottom and the plurality of walls having an internal surface and an external surface;

a plurality of shelf structures, wherein each shelf structure is formed on at least a portion of each of the plurality of walls within the internal space;

a first puck assembly and a second puck assembly, each puck assembly removably disposable in the internal space and comprising:

a plate surface in a plane parallel to the bottom of the base;

a functional surface formed generally opposite to the plate surface and having a plurality of food receptacles formed thereon;

a sealed cavity disposed between the plate surface and the functional surface;

a cooling substance disposed in the sealed cavity; and a rim extending around a circumference of the plate surface, the rim having a first surface generally parallel to and offset below the plate surface;

wherein each puck assembly may be removably disposed in the internal space in a first orientation and a second orientation independent of the orientation of the other puck assembly, and wherein the first surface of the respective rim of each puck assembly is disposed on at least two of the plurality of shelf structures when that puck assembly is in the first orientation, so that the functional surface is adjacent to the internal surface of the bottom, and the plate surface is disposed on at least two shelf structures when the puck assembly is in the second orientation, so that the plate surface is closer to the internal surface of the bottom than is the functional surface;

a first food tray and a second food tray removably disposable within the internal space proximate the first and second puck assemblies; and a plurality of stop structures, wherein each stop structure is formed on a wall and engages the first puck assembly and the second puck assembly to prevent lateral movement thereof, and the plurality of stop structures engage the first food tray and the second food tray to prevent lateral movement thereof.

11. The device of claim 10, further comprising a lid shaped to alternatively fit on a top surface of each of the plurality of walls to close the internal space and to fit on the external surface of the base.

12. The device of claim 10, wherein the first food tray and the second food tray each comprise a plurality of storage compartments.

13. The device of claim 12, wherein the first food tray is nestable within the second food tray.

14. The device of claim 10, wherein each food tray is shaped so as to be disposed above one of the puck assemblies.

15. The device of claim 10, wherein each food tray is shaped so as to be disposed above a portion of both the first and the second puck assemblies.

16. The device of claim 10, wherein each food tray engages at least two of the shelf structures when the puck assemblies are not disposed in the internal space.

17. The device of claim 10, further comprising a first pair of handles, wherein the one of the first pair of handles is located on the first wall, and the other of the first pair of handles is located on the second wall.

18. The device of claim 17, further comprising a lid having a second pair of handles disposed on opposite sides of the lid, wherein the second pair of handles is shaped to engage with the first pair of handles both when the lid is engaged to the top of the plurality of walls and when the lid is engaged to the external surface of the base.

19. The device of claim 18, further comprising a locking structure formed on each handle of the second pair of handles, wherein each locking structure cooperates with the respective one of the first pair of handles to prevent inadvertent removal of the lid.

* * * * *